US006293203B1

(12) United States Patent
Alexander et al.

(10) Patent No.: US 6,293,203 B1
(45) Date of Patent: Sep. 25, 2001

(54) FIREARMS AND AMMUNITION

(76) Inventors: William Rogers Henry Alexander, Coton House Farm, Coton Lane, Ranton, Stafford. ST18 9JY; Trevor Joe Barraclough, 18 Lovatt Street, Stafford. ST16 3DB, both of (GB)

( * ) Notice: Subject to any disclaimer, the term of this patent is extended or adjusted under 35 U.S.C. 154(b) by 0 days.

(21) Appl. No.: 09/069,301

(22) Filed: Apr. 29, 1998

Related U.S. Application Data

(63) Continuation-in-part of application No. PCT/GB97/02581, filed on Sep. 22, 1997.

(51) Int. Cl.[7] ..... F42B 5/28; F42B 5/02

(52) U.S. Cl. ..... 102/430; 102/464; 42/76.01; 89/14.05

(58) Field of Search ..... 102/430, 464–470; 42/76.01; 89/14.05

(56) References Cited

U.S. PATENT DOCUMENTS

| | | | |
|---|---|---|---|
| 3,136,084 | 6/1964 | Charron . | |
| 3,998,161 | 12/1976 | Booth | 102/430 |
| 5,094,169 | 3/1992 | Evitts | 102/464 |
| 5,507,232 | 4/1996 | Valdez | 102/464 |

FOREIGN PATENT DOCUMENTS 1314542 4/1970 (GB) .

OTHER PUBLICATIONS

Frank C. Barnes: Cartridges of the World; 1972, Follet Publishing Company/Digest Books, Inc., Chicago, USA XP002049245; ISBN 0–695–80326–3; pp. 8, 10, 20, 46, 59, 66, 125–157, 177, 178 See pages 127, 128, 143, 148 & 177.78.

Karl R. Pawlas: Munitionshandbuch 1973, Verlag Karl R. Pawlas, Nurnberg, Germany.

Small Arms Identification Guide 1968, Paladin Press, Boulder, USA.

"Lyman Reloading Handbook For Rifle,Pistol and Muzzle Loading", Edited by Jim Sheridan, 1970 pages 145,156–158.*

* cited by examiner

*Primary Examiner*—Harold J. Tudor
(74) *Attorney, Agent, or Firm*—Needle & Rosenberg, P.C.

(57) ABSTRACT

The invention relates to ammunition suitable for firing from a self-loading sidearm comprising a cartridge adapted to fire a projectile, the cartridge case having at one end a portion of reduced diameter, the projectile being held in the said portion of reduced diameter, wherein the ratio of the external diameter of the cartridge case at its widest point to the external diameter of the projectile at its widest point is such that when the projectile is fired into a target high velocity wounding is caused. The invention also relates to a gun barrel for a self-loading sidearm through which the ammunition can be shot, and a self-loading sidearm comprising such a barrel.

29 Claims, 10 Drawing Sheets

FIREARMS AND AMMUNITION

This application is a Continuation-in-part of Application No. PCT/GB97/02581, designating the United States, filed on Sep. 22, 1997.

FIELD OF THE INVENTION

The invention relates to sidearms, and in particular to improved ammunition and improved sidearms to fire such ammunition.

BACKGROUND TO THE INVENTION

There is a need for ammunition capable of being fired from a sidearm or other lightweight firearms which has high muzzle velocity, great penetrative power and excellent accuracy. None of these characteristics is found in present ammunition types suitable for firing from a sidearm or other light weight firearms. The need is particularly great in police forces and special forces. Body armour which is currently available makes most sidearms ineffective. However, in many cases a rifle, which would provide the penetrative power necessary is not suitable, simply because it cannot be drawn quickly enough, and can be difficult to conceal.

It is well understood by those skilled in the art of weaponry that firearms fall into four separate families, those being:

a) Small calibre weapons using ammunition ranging in size from 0.22 inch which are commonly fired from small handguns;

b) Small arms weapons which use straight sided centre fire ammunition, the ammunition being fired from handguns and semi-automatic guns, the common bores being 0.38 inch, 0.357 inch, 0.44 inch, 9 mm and 10 mm which offer accuracy over a range up to 50 meters;

c) Combat rifles which fire ammunition sending projectiles at very high velocities over ranges of 500 meters plus, the common bores being 0.223 inch (5.56 mm), 5.7 mm, 0.303 inch, 7.62 mm and 0.50 inch; and d) Heavy weapons for firing ammunition up to 2 kilometers commonly having bores of 20 mm, 30 mm and larger, and which are used in extreme range combat to deliver large payloads, e.g. anti-tank and anti-aircraft ammunition.

Small arms and small calibre weapons are convenient simply because they are small and lightweight, which makes them easy to use and carry about the person. However, the performance of these types of weapon is limited. They cannot fire projectiles over long distances, and furthermore are very inaccurate at anything more than short distances. In general, pistol ammunitions have projectiles of a diameter which corresponds to the internal diameter of the cartridge case, the walls of the cartridge case being parallel, whereas rifle ammunitions have projectiles significantly smaller in diameter than the cartridge cases to which they are attached. The result is a projectile which travels further and is more accurate. The cartridge cases of known rifle ammunitions are much longer than the cartridge cases for automatic and semiautomatic sidearm type weapons.

The types of wound produced by standard pistol and rifle ammunitions are quite different. Pistol ammunition produces low velocity wound characteristics, characterised in animals by the destruction of tissue in the path of the projectile, and a minor amount of secondary cavity damage around the path of the projectile. It is the effect of the projectile destroying objects in its path which neutralises the target. On the other hand, rifle ammunition produces high velocity wounding where it is not only destruction of tissue by the projectile which causes neutralisation, but primarily damage to tissues caused by a velocity induced shock wave. The projectile itself causes limited damage, but it is the shock wave induced by the projectile which results in severe trauma damage, sometimes known as temporary cavity damage. It is understood that a projectile must hit a target when travelling at velocity of at least 518 meters per second for high velocity wounding to occur.

Single shot pistols, often being of bolt action type have been adapted to receive a rifle cartridge. However, it would be desirable to produce ammunition suitable for a standard sidearm or other lightweight firearms capable of producing high velocity wounding in a target.

Many attempts have been made to optimise the performance of small arms and small calibre weapons. Each time the result has been a larger weapon. For example the Calico made by Calico Arms, and the P90 made by FN. Although both of these weapons increase the accuracy and distance of the projectile fired, both have disadvantages. The only known ammunition for use in sidearms which utilised a projectile of smaller diameter than the internal diameter of the cartridge case to which it was attached was the Mauser Parabellam, which consisted of a projectile having an external diameter of 7.65 mm attached to a case having an external diameter of 9.6 mm. Whilst improved velocity and penetrative capacity were noted, this ammunition still produced low velocity wound characteristics.

Many of the improved weapons also suffer problems in their re-arranged feed mechanisms and magazines.

The constraints of a small automatic or semi-automatic weapon mean that small compact ammunition having a short case length is required. Assuming that the weapon is to provide a reasonable number of shots then the ammunition will generate a low velocity, have drastically reduced terminal effects, and produce problems with terminal effects as a result of its small size.

The problem in controlling the burn characteristics of the powder in cartridge cases suitable for use in automatic or semi-automatic sidearms have lead those skilled in the art to develop ammunition having parallel sides. However, there is a need for police officers to be provided with firearms having penetrative power greater than that which sidearms can presently provide but which are easier to handle than conventional rifles.

There is a limit velocity above which a projectile of a given diameter will cause a high velocity wound in an animal, and the term "limit velocity" shall be understood to mean the velocity at or above which the projectile in question causes high velocity wounding.

It would therefore be desirable to provide ammunition capable of being fired from a sidearm which has a longer range and gives greater accuracy than currently available ammunition. It would also be desirable to provide a firearm suitable for, or to modify parts of existing firearms to make them capable of, firing such ammunition.

It would be advantageous to be able to utilise commonly available projectiles, for example projectiles made from lead which could be copper jacketed. It would also be advantageous to be able to utilise commonly available cartridge cases.

Furthermore, it would be desirable to provide ammunition for a self-loading, automatic or semi-automatic, sidearm capable of firing the projectile at a velocity in excess of the limit velocity for the said projectile.

The term sidearm shall be understood to mean pistols or sub-machine guns.

The term self-loading shall be understood to mean semi-automatic or automatic feed mechanisms.

SUMMARY OF THE INVENTION

The invention provides self-loading sidearms ammunition comprising a cartridge case and a projectile the said projectile having a limit velocity, the cartridge case having at one end a portion of reduced diameter, the projectile being held in the said portion of reduced diameter, and the ammunition being adapted to fire the projectile, wherein the ratio of the external diameter of the cartridge case at its widest point to the external diameter of the projectile at its widest point is greater than 1.26 to 1.

One aspect of the invention provides self-loading sidearms ammunition comprising a cartridge case and a projectile the said projectile having a limit velocity, the cartridge case having at one end thereof a portion of reduced diameter, the projectile being held in the said portion of reduced diameter, and the cartridge being adapted to fire the projectile, wherein the length of the cartridge case is less than 26 millimeters, and wherein the ratio of the external diameter of the cartridge case at its widest point to the external diameter of the projectile at its widest point is such that when the ammunition is fired in a weapon having a barrel the muzzle velocity of the projectile is not less than the limit velocity, high velocity wounding being caused when the projectile hits a target.

Preferably, the muzzle velocity is not less than 518 meters per second.

The invention also provides a cartridge case having at one end a portion of reduced diameter to receive a projectile therein, wherein the ratio of the external diameter of the cartridge case at its widest point to the internal diameter of the portion of reduced diameter at its widest point is greater than 1.26 to 1, and is preferably between 1.5 to 1 and 2.8 to 1, and still more preferably is 1.3 to 1 and 2.0 to 1.

Preferably, the ratio of the external diameter of the cartridge case at its widest point to the external diameter of the projectile at its widest point is between 1.5 to 1 and 2.8 to 1.

Preferably, the external diameter of the cartridge case at its widest point is 1.3 to 2.0 times the external diameter of the projectile.

Even more preferably, the external diameter of the cartridge case at its widest point is substantially 1.8 times the external diameter of the projectile.

Still more preferably, the external diameter of the projectile is substantially 5.56 mm, and the external diameter of the cartridge case is substantially 10.80 mm.

Advantageously, the cartridge case is formed from a standard parallel sided cartridge case, having a length of between 17 and 25 mm.

The projectile may be a standard 5.56 mm (0.224 inch) projectile.

The cartridge may be formed from a standard parallel sided 10 mm cartridge case, having a length of 25 mm.

The cartridge may be formed from a standard 40 Smith & Wesson parallel sided cartridge case, having a length of 21.5 mm.

The cartridge case may be a high pressure or low pressure case.

In another embodiment of the invention, the external diameter of the cartridge case is substantially 9.6 mm and the external diameter of the projectile is greater than or equal to 4.5 mm and less than or equal to 6 mm.

In another aspect of the invention the external diameter of the cartridge case is substantially 12 mm and the external diameter of the projectile is greater than or equal to 4.5 mm and less than or equal to 6 mm.

The cartridge case may be swaged to provide the portion of reduced diameter. For example a standard 10 mm cartridge case may be swaged at one end to provide the portion of reduced diameter.

The cartridge case is preferably formed from brass.

The projectile may be a standard full metal jacketed projectile.

The powder used in the cartridge is preferably a nitro based powder.

Preferably, the length of the cartridge case is in the range 17 mm to 26 mm. More preferably, the length of the cartridge case is in the range 21 mm to 24 mm. Even more preferably, the length of the cartridge case is substantially 23 mm.

One aspect of the invention also provides a gun barrel having a chamber at one end so shaped and dimensioned as to receive ammunition according to the invention, one end of the said chamber entering into a rifled barrel of a diameter corresponding to the diameter of the projectile to be shot therethrough.

Another aspect of the invention provides a self-loading sidearm comprising a gun barrel having a chamber at one end so shaped and dimensioned as to receive ammunition according to the invention, one end of the said chamber entering into a rifled barrel of a diameter corresponding to the diameter of the projectile to be shot therethrough.

The ammunition of the invention fires its projectile at a much greater velocity, and therefore over a much longer range than would be the case with ammunition attached to a straight sided cartridge case. This is because the diameter of the projectile is less than the diameter of the case.

The ammunition of the invention is compact, i.e. short, and allows sidearms and other light weight weapons to fire projectiles which behave in a similar manner to projectiles fired from rifles where the cartridge cases are relatively long, from weapons which cannot fire rifle type ammunition. The projectiles fired from ammunition according to the invention can produce high velocity wounding.

The ammunition uses known components which are the subject of considerable research regarding flight characteristics and terminal effects.

Existing sidearms can easily be modified to use the ammunition of the invention by the replacement of a standard barrel with a barrel according to the invention. This can enable the modified weapon's own feed mechanism to be utilised.

BRIEF DESCRIPTION OF THE DRAWINGS

In the drawings which illustrate exemplary embodiments of the invention.

DETAILED DESCRIPTION OF THE PREFERRED EMBODIMENTS

Figure 1:
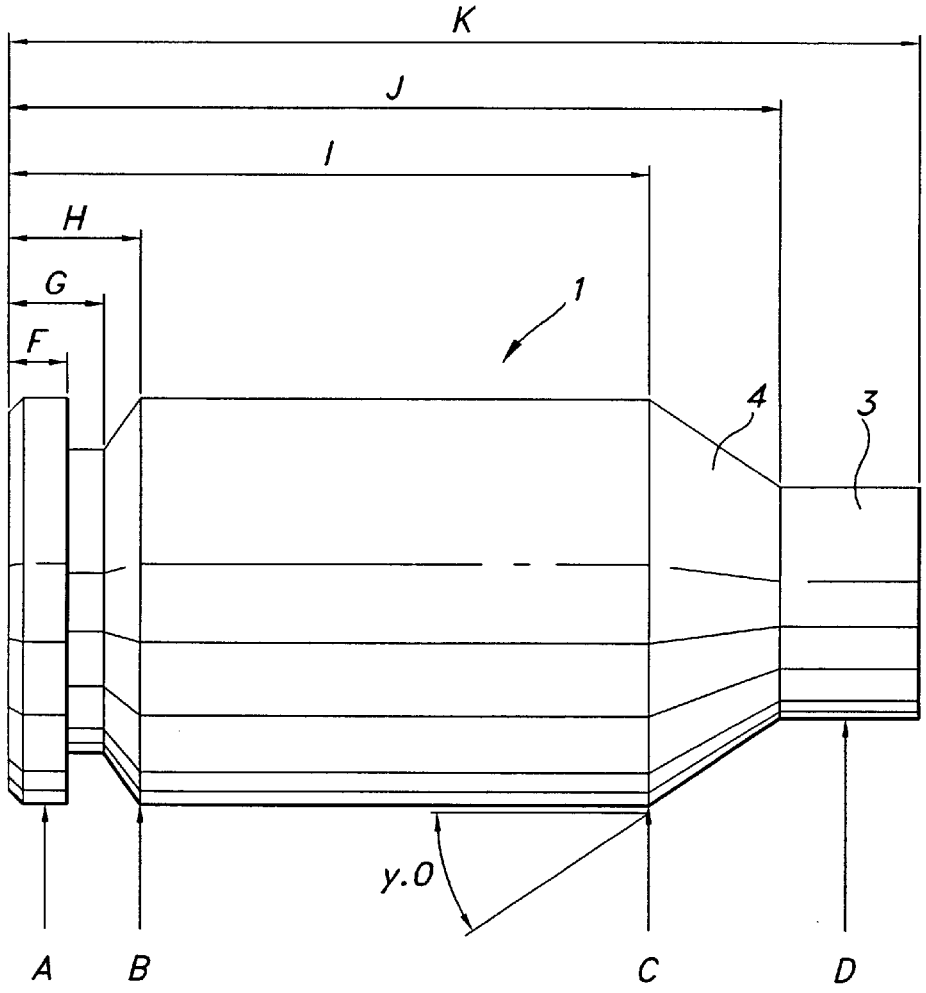
FIG. 1 is a side view of a cartridge case comprising part of ammunition according to the invention.

FIG. 1 shows a cartridge case 1 having a primer 2 attached to one end thereof. At the other end of the case 1 there is a portion of reduced diameter 3. In the region 4 between the straight sided portion of the cartridge case 1 and the portion of reduced diameter 3, the sides of the cartridge case slope.

In the preferred embodiment the diameters A and B are 10.80 mm, the diameter C is 10.75 mm, the diameter D of the portion of reduced diameter 3 is 6.46 mm, and the internal diameter E is 5.66 mm. In another embodiment the diameter A is smaller than the diameter B.

Letters F to K designate lengths of different parts of the cartridge case 1. In the preferred embodiment K is 23.00 mm, J is 19.25 mm, I is 15.82 mm, H is 3.20 mm, G is 2.48 mm and F is 1.40 mm.

The angle y is 32 degrees in the preferred embodiment.

The cartridge case 1 is formed by taking a standard 25 mm cartridge case and forming the portion of reduced diameter and the region having sloping sides by means of swaging.

The internal diameter E of 5.66 mm accommodates a standard 0.224 inch (5.56 mm) projectile.

Figure 2:
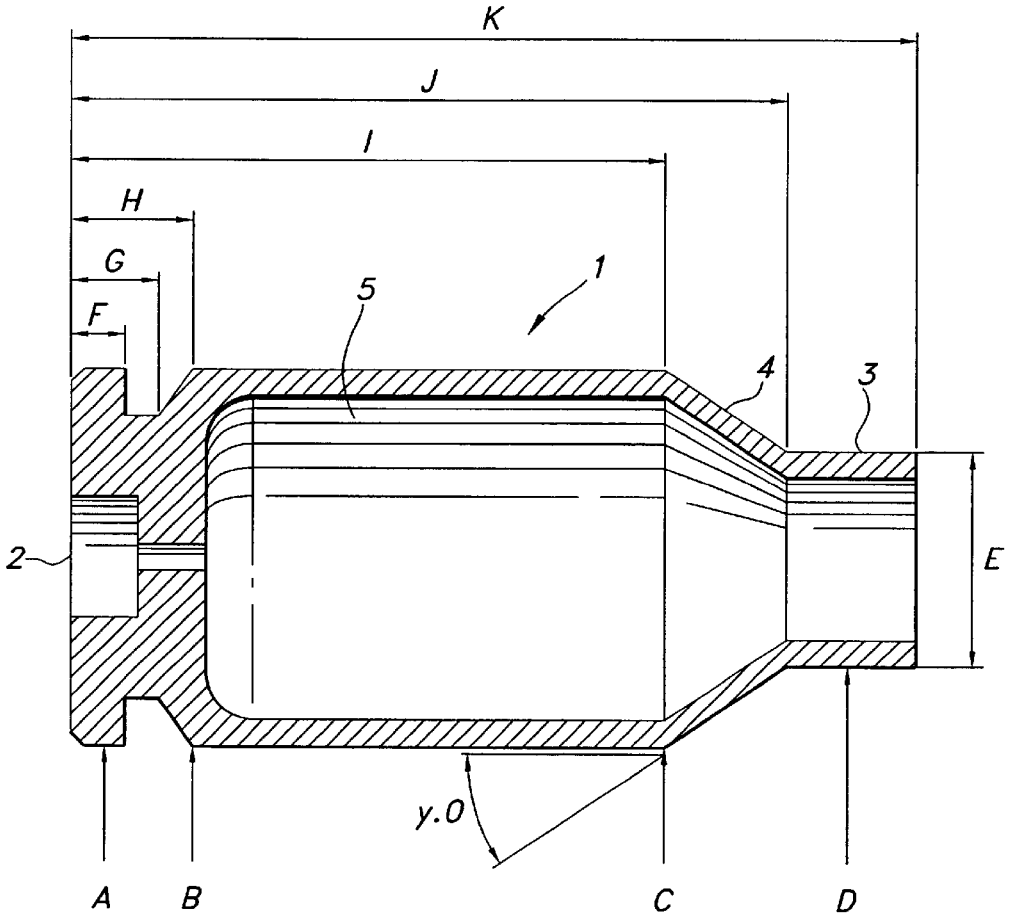
FIG. 2 is a cross-section of a cartridge case comprising part of ammunition according to the invention.
Figure 3:
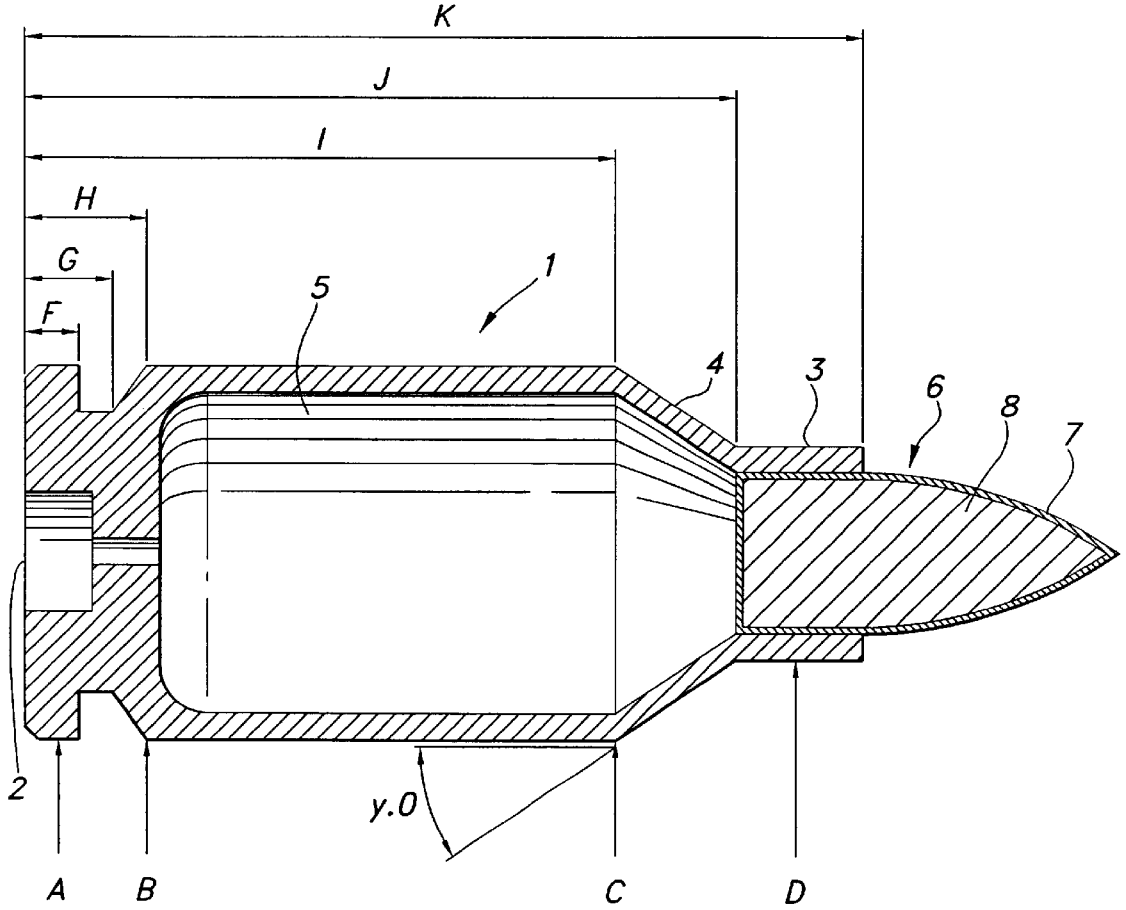
FIG. 3 is a cross-section of ammunition according to the invention.

The cartridge case 1 is shown in cross-section in FIGS. 2 and 3, and it can be seen that the case 1 has an internal chamber 5 in which powder is held. As can be seen from FIG. 3, a projectile 6 is fitted in the portion of reduced diameter 3. As the powder (not shown) held in the internal chamber 5 burns energy is released, and so the projectile is forced out of the cartridge case 1.

The projectile 6 comprises an inner shaped steel or lead mass 8, surrounded by a copper jacket 7. Many different projectiles of a size suitable to fit into the portion of reduced diameter 3 are known and may be used in place of the projectile 6 shown.

Figure 4:
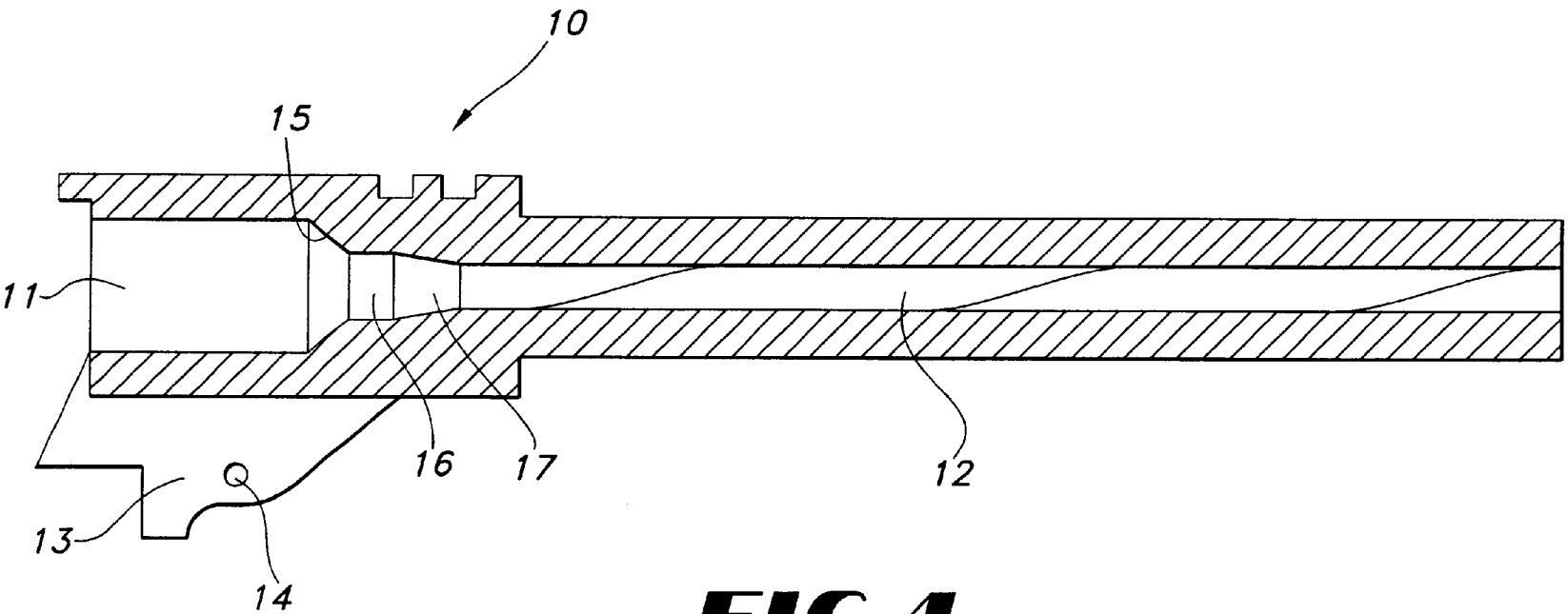
FIG. 4 is a crosssection of a barrel according to another aspect of the invention.
Figure 5:
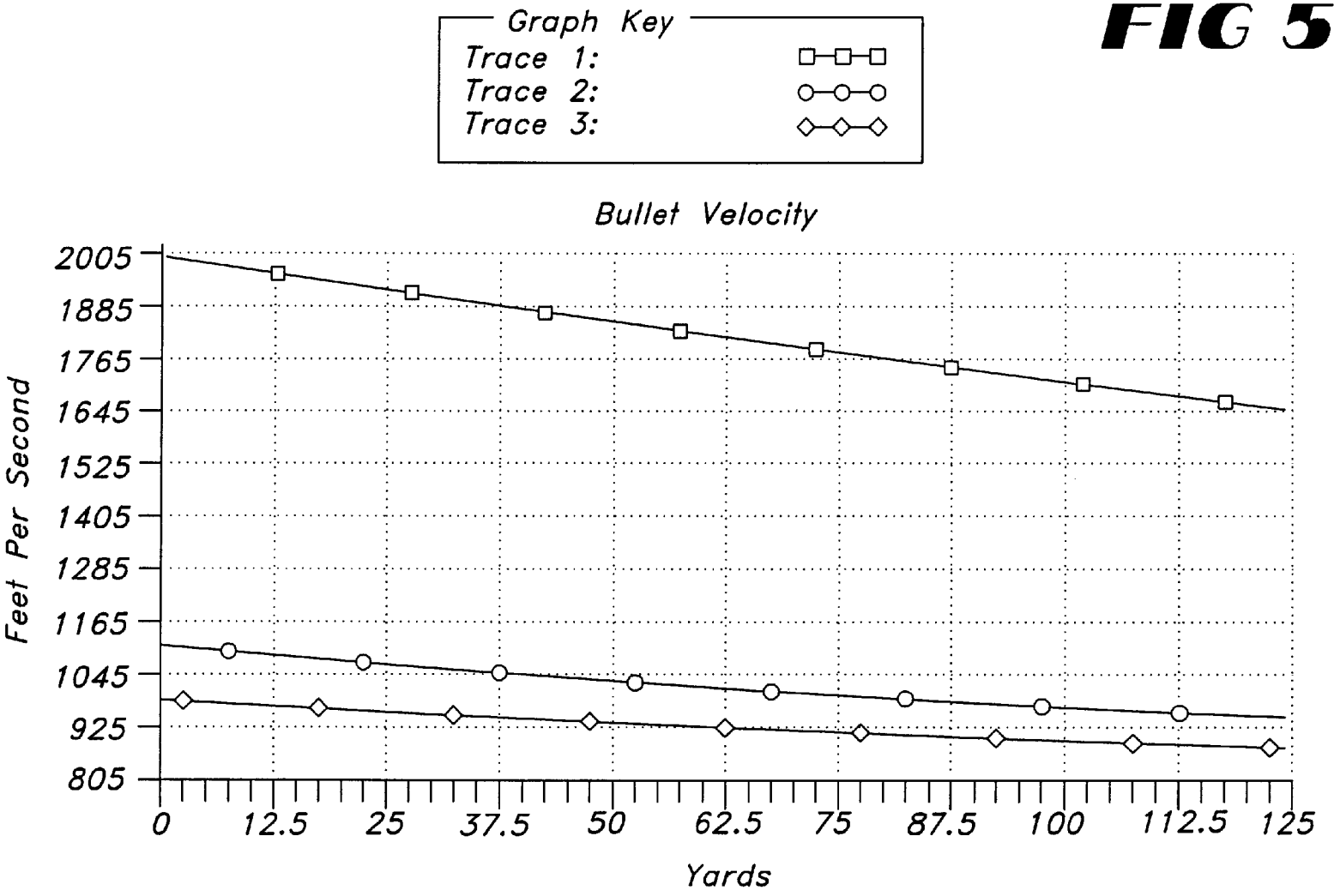
FIG. 5 is a graph of bullet velocity against distance for the ammunition of the invention and two other ammunition types of the art.
Figure 6:
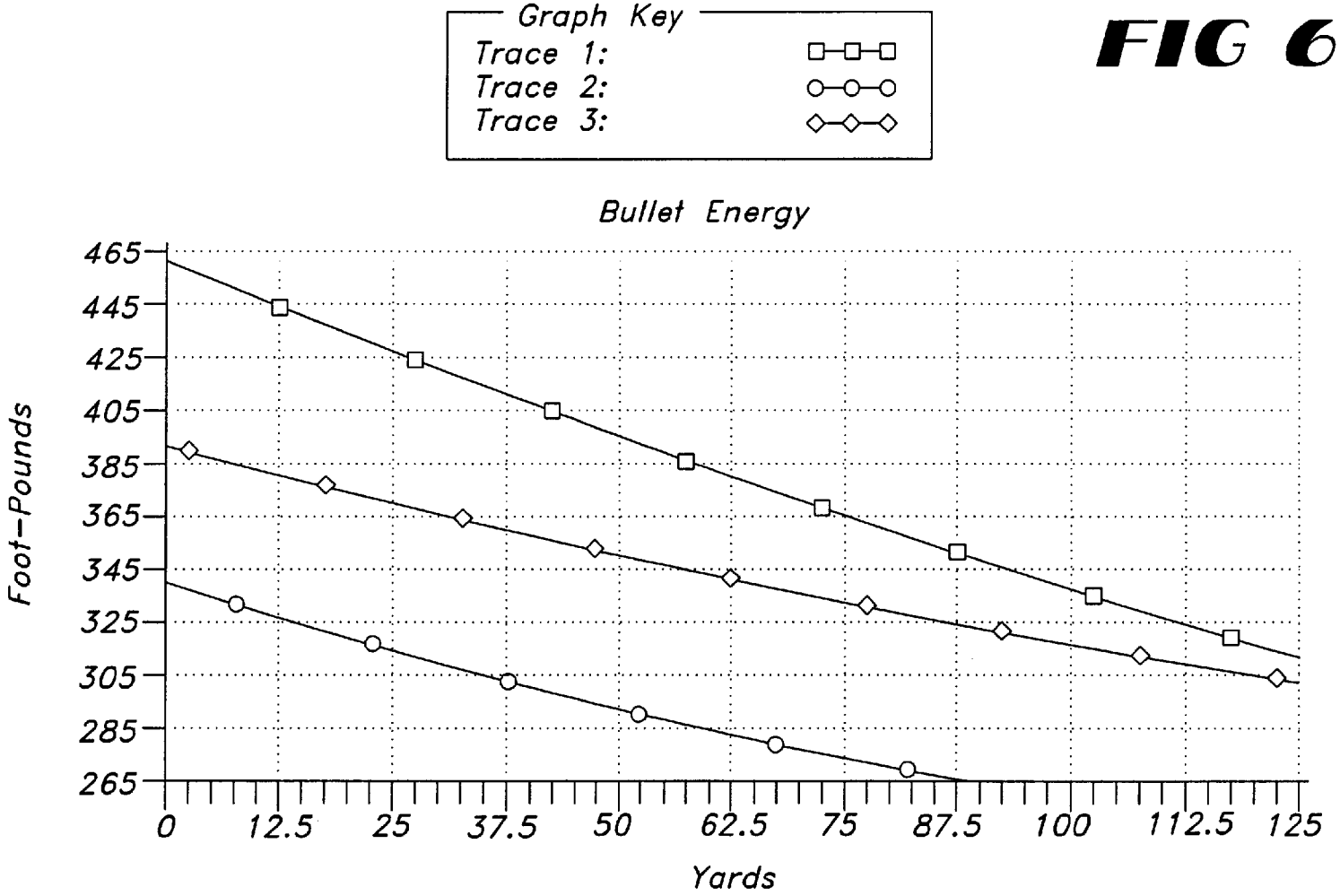
FIG. 6 is a graph of bullet energy against distance for the ammunition of the invention and two other ammunition types of the art.
Figure 7:
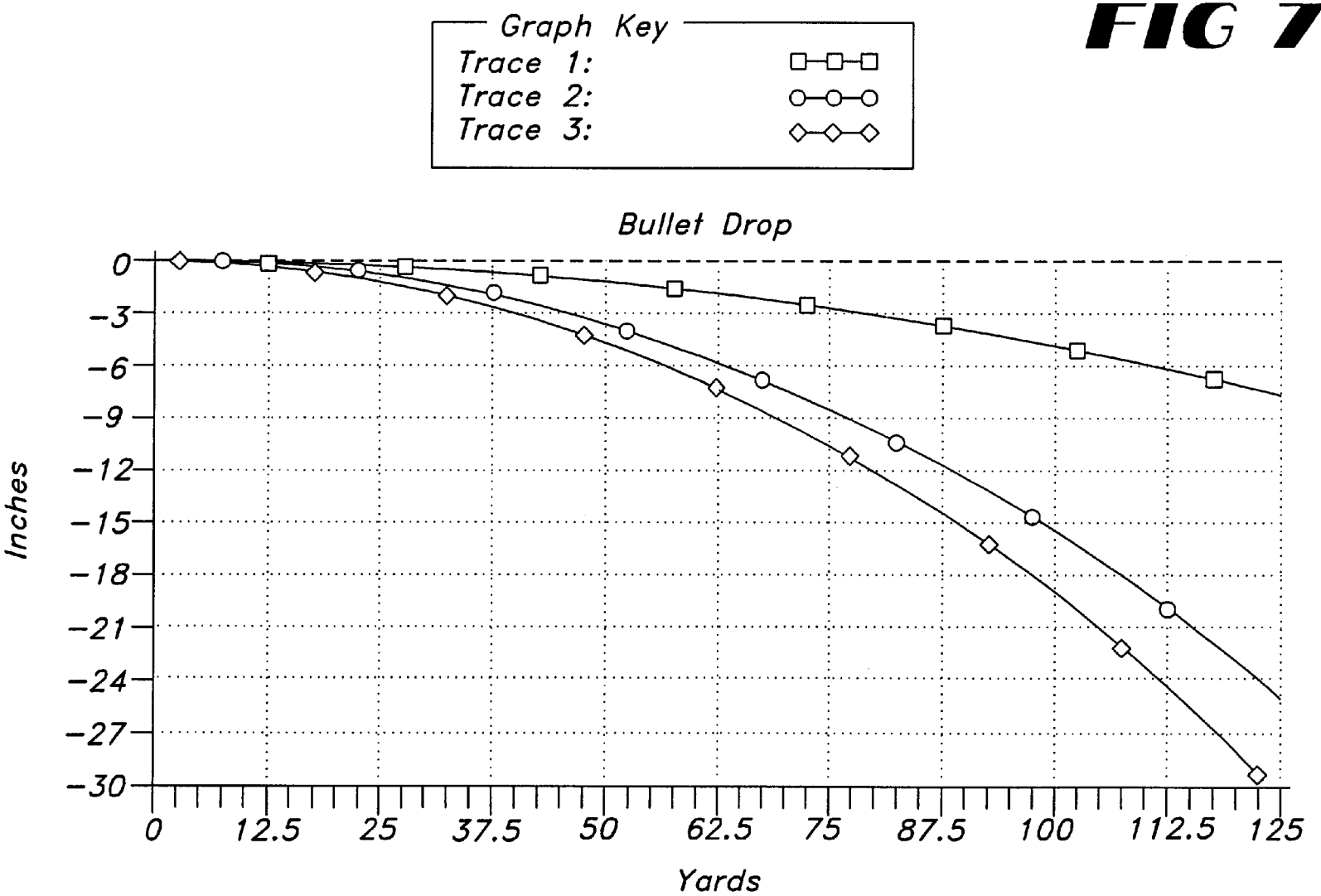
FIG. 7 is a graph of bullet drop against distance for the ammunition of the invention and two other ammunition types of the art.
Figure 8:
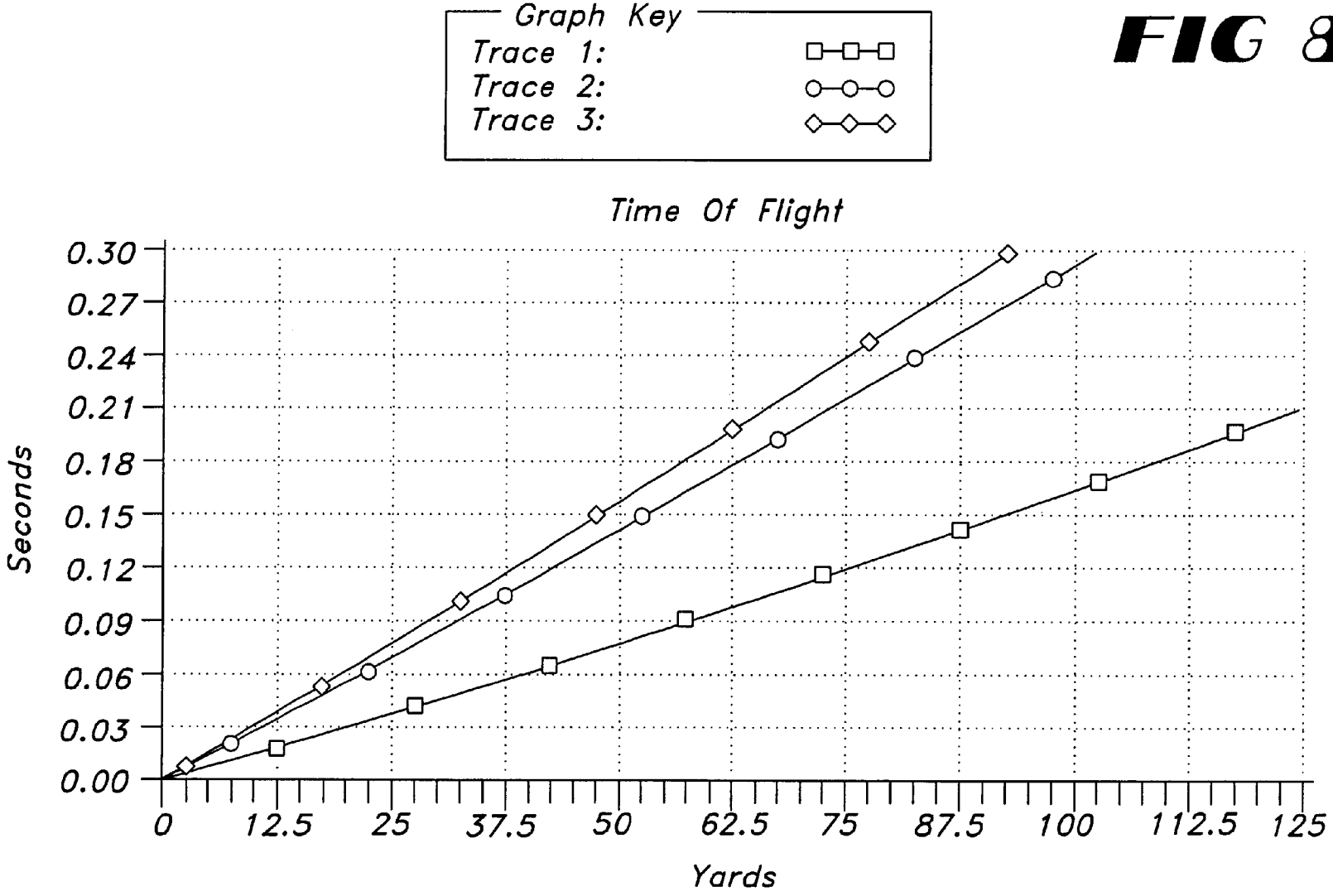
FIG. 8 is a graph of time of flight against distance for the ammunition of the invention and two other ammunition types of the art.
Figure 9:
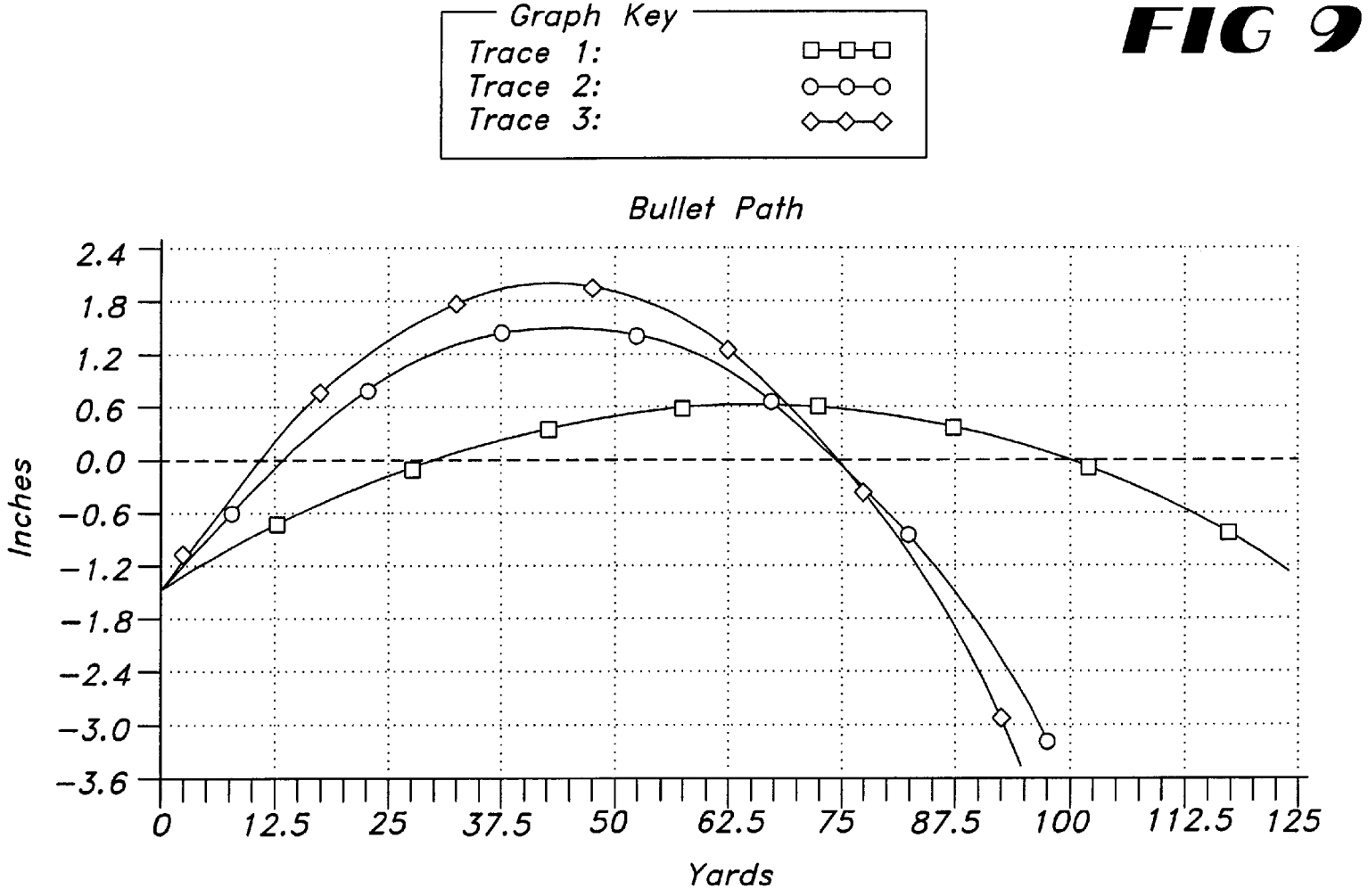
FIG. 9 is a graph of bullet path against distance for the ammunition of the invention and two other ammunition types of the art.
Figure 10:
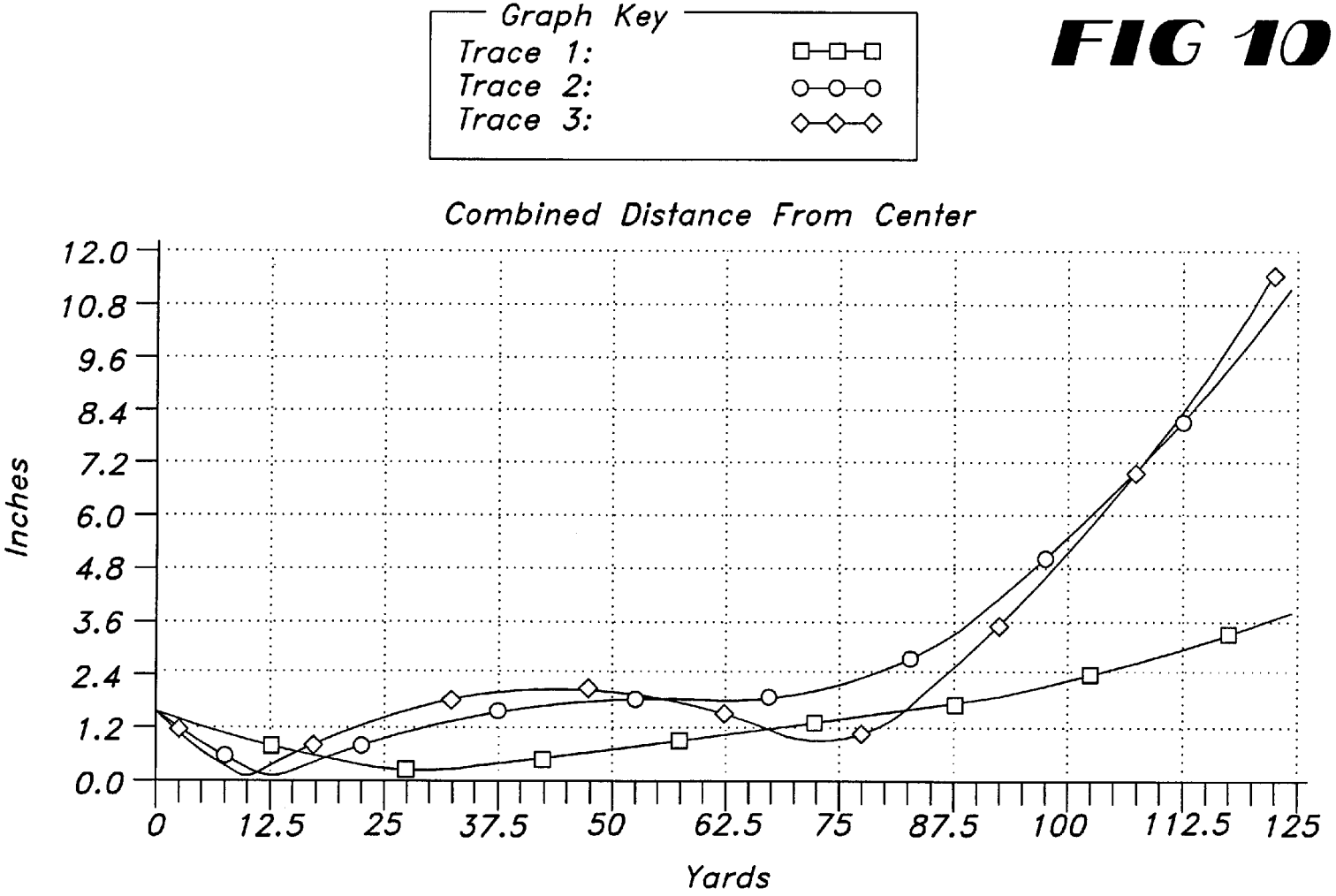
FIG. 10 is a graph of combined distance from centre against distance for the ammunition of the invention and two other ammunition types of the art.

In FIG. 4 there is shown a barrel 10, comprising at one end a chamber 11 which is shaped to accommodate ammunition according to the invention, and a rifled barrel section 12.

The barrel 10 is attached to a weapon by means of block 13 having an aperture 14 through which a pin may pass.

The chamber 11 has a sloping face 15 and a portion of reduced diameter 16 which co-operate with the sloping face 4 and portion of reduced diameter 3 of the cartridge case shown in FIGS. 1 and 2. In the barrel 10, beyond the portion of reduced diameter 16, the diameter of chamber 11 tapers 17 for a short distance to the end of the chamber 11. At the end of the chamber 11, the rifled barrel section 12 begins.

Tapered section 17 accommodates a projectile such as the projectile 6 shown in FIG. 3.

The dimensions of the chamber may be nominally 0.1 mm greater than those of the ammunition according to the invention.

FIGS. 5 to 10 are graphs showing the performance of the ammunition of the present invention compared with the performance of 9 mm FMJ and 0.40 Smith and Wesson as modelled on the "Oehler Ballistic Explorer". In each graph, trace 1 indicates the performance of the ammunition of the invention, trace 2 indicates the performance of 9 mm FMJ ammunition, and trace 3 indicates the performance of 0.40 mm Smith and Wesson ammunition. Each of the graphs serves to show that the ammunition of the invention significantly out performs the 9 mm FMJ and the 0.40 Smith and Wesson.

We claim:

1. Self-loading sidearms ammunition comprising a cartridge case and a projectile, said projectile having a limit velocity that is not less than 518 meters/second, the cartridge case having a substantially cylindrical first portion of a first diameter, a substantially cylindrical second portion of reduced diameter, and a conical portion intermediate the first portion and the second portion, the projectile being held in said portion of reduced diameter, and the cartridge being adapted to fire the projectile, wherein the length of the cartridge case is less than or equal to 26 millimeters, wherein the ratio of the external diameter of the cartridge case at its widest point to the external diameter of the projectile at its widest point is such that, when the ammunition is fired in a weapon having a barrel, high velocity wounding is caused when the projectile hits a target at at least the limit velocity, wherein the ratio of the external diameter of the cartridge at its widest point to the diameter of the external diameter of the projectile at its widest point is greater than or equal to 1.4 to 1, and wherein said projectile is jacketed.

2. Ammunition according to claim 1, wherein the muzzle velocity of the projectile is not less than 518 meters per second.

3. Ammunition according to claim 1, wherein the ratio of the external diameter of the cartridge case at its widest point to the external diameter of the projectile at its widest point is between 1.5 to 1 and 2.8 to 1.

4. Ammunition according to claim 1, wherein the ratio of the external diameter of the cartridge case at its widest point to the external diameter of the projectile at its widest point is between 1.4 to 1 and 2.0 to 1.

5. Ammunition according to claim 1, wherein the ratio of the external diameter of the cartridge case at its widest point is substantially 1.8 times the external diameter of the projectile.

6. Ammunition according to claim 1, wherein the ratio of the external diameter of the cartridge case at its widest point to the internal diameter of the portion of reduced diameter at its widest point is greater than 1.4 to 1.

7. Ammunition according to claim 6, wherein the ratio of the external diameter of the cartridge case at its widest point to the internal diameter of the portion of reduced diameter at its widest point is between 1.5 to 1 and 2.8 to 1.

8. Ammunition according to claim 6, wherein the ratio of the external diameter of the cartridge case at its widest point to the internal diameter of the portion of reduced diameter at its widest point is between is 1.3 to 2.0.

9. Ammunition according to claim 1, wherein the external diameter of the projectile is substantially 5.56 mm, and the external diameter of the cartridge case is substantially 10.80 mm.

10. Ammunition according to claim 1, wherein the cartridge case is formed from a substantially parallel sided cartridge case, having a length of between 17 and 25 mm.

11. Ammunition according to claim 1, wherein the projectile is a 5.56 mm projectile.

12. Ammunition according to claim 1, wherein the cartridge case is formed from a substantially parallel sided 10 mm cartridge case, having a length of 25 mm.

13. Ammunition according to claim 1, wherein the cartridge is formed from a 40 Smith & Wesson substantially parallel sided cartridge case, having a length of 21.5 mm.

14. Ammunition according to claim 1, wherein the external diameter of the cartridge case is substantially 9.6 mm and the external diameter of the projectile is not less than to 4.5 mm and not greater than 6 mm.

15. Ammunition according to claim 1, wherein the external diameter of the cartridge case is substantially 12 mm and the external diameter of the projectile is not less than 4.5 mm and not greater than 6 mm.

16. Ammunition according to claim 1, wherein the cartridge case is swaged to provide the portion of reduced diameter.

17. Ammunition according to claim 1, wherein the cartridge case is formed from brass.

18. Ammunition according to claim 1, wherein the projectile is a full metal jacketed projectile.

19. Ammunition according to claim 1, wherein the length of the cartridge case is in the range 17 mm to 26 mm.

20. Ammunition according to claim 19, wherein the length of the cartridge case is in the range 21 mm to 24 mm.

21. Ammunition according to claim 20, wherein the length of the cartridge case is substantially 23 mm.

22. A combination of a self-loading sidearms gun barrel and ammunition, said gun barrel having a chamber at one end so shaped and dimensioned as to receive said self-loading sidearms ammunition comprising a cartridge and a projectile, said projectile having a limit velocity that is not less than 518 meters/second, the cartridge case having a substantially cylindrical first portion of a first diameter, a substantially cylindrical second portion of reduced diameter, and a conical portion intermediate the first portion and the second portion, the projectile being held in said portion of reduced diameter, and the cartridge being adapted to fire the projectile, wherein the length of the cartridge case is less than or equal to 26 millimeters, wherein the ratio of the external diameter of the cartridge case at its widest point to the external diameter of the projectile at its widest point is such that, when the ammunition is fired through the barrel, high velocity wounding is caused when the projectile hits a target at at least the limit velocity, wherein the ratio of the external diameter of the cartridge at its widest point to the diameter of the external diameter of the projectile at its widest point is greater than or equal to 1.4 to 1, wherein said projectile is jacketed, and wherein one end of said chamber enters into a rifled barrel of a diameter corresponding to the diameter of the projectile.

23. The combination according to claim 22, wherein the projectile exits the barrel at a muzzle velocity that is not less than 518 meters per second.

24. A combination of a self-loading sidearm comprising a gun barrel and ammunition, said gun barrel having a chamber at one end so shaped and dimensioned as to receive said self-loading sidearms ammunition comprising a cartridge and a projectile, the cartridge case having a first portion of a first diameter, a second portion of reduced diameter, and a conical portion intermediate the first portion and the second portion, the projectile being held in said portion of reduced diameter, and the cartridge being adapted to fire the projectile, wherein the length of the cartridge case is less than or equal to 26 millimeters, wherein the ratio of the external diameter of the cartridge case at its widest point to the external diameter of the projectile at its widest point is such that, when the ammunition is fired, the projectile exits the barrel at a muzzle velocity sufficient to strike a remote target at not less than 518 meters/second to cause high velocity wounding, wherein the ratio of the external diameter of the cartridge at its widest point to the diameter of the external diameter of the projectile at its widest point is greater than or equal to 1.4 to 1, wherein said projectile is jacketed, and wherein one end of said chamber enters into a rifled barrel of a diameter corresponding to the diameter of the projectile.

25. The combination according to claim 24, wherein the muzzle velocity of the projectile is not less than 518 meters per second.

26. The combination according to claim 24, wherein the feed mechanism of the sidearm is automatic.

27. The combination according to claim 24, wherein the feed mechanism is semiautomatic.

28. Self-loading sidearms ammunition comprising a cartridge case and a projectile, said projectile having a limit velocity that is not less than 518 meters/second, the projectile having a substantially cylindrical back end, an opposing substantially pointed tip end, and a circumferentially extending jacket wall extending between the back end and the tip end of the projectile, the projectile further having a longitudinal axis, wherein a portion of the jacket wall proximate the tip end of the projectile curves inwardly toward the longitudinal axis of the projectile to form the substantially pointed tip end of the projectile, the cartridge case having a first portion of a first diameter, a second portion of reduced diameter, and a conical portion intermediate the first portion and the second portion, a portion of the projectile proximate the back end of the projectile being held in said portion of reduced diameter, and the cartridge being adapted to fire the projectile, wherein the length of the cartridge case is less than or equal to 26 millimeters, wherein the ratio of the external diameter of the cartridge case at its widest point to the external diameter of the projectile at its widest point is such that, when the ammunition is fired in a weapon having a barrel, the projectile exits the barrel at a muzzle velocity sufficient to strike a remote target at not less than 518 meters/second, and wherein the ratio of the external diameter of the cartridge at its widest point to the diameter of the external diameter of the projectile at its widest point is greater than or equal to 1.4 to 1.

29. A combination of a self-loading sidearm comprising a gun barrel and ammunition, said gun barrel having a chamber at one end so shaped and dimensioned as to receive said self-loading sidearms ammunition comprising a projectile and a cartridge, the projectile having a substantially cylindrical back end, an opposing substantially pointed tip end, and a circumferentially extending jacket wall extending between the back end and the tip end of the projectile, the projectile further having a longitudinal axis, wherein a portion of the jacket wall proximate the tip end of the projectile curves inwardly toward the longitudinal axis of the projectile to form the substantially pointed tip end of the projectile, the cartridge case having a first portion of a first diameter, a second portion of reduced diameter, and a conical portion intermediate the first portion and the second portion, the projectile being held in said portion of reduced diameter, and the cartridge being adapted to fire the projectile, wherein the length of the cartridge case is less than or equal to 26 millimeters, wherein the ratio of the external diameter of the cartridge case at its widest point to the external diameter of the projectile at its widest point is such that, when the ammunition is fired, the projectile exits the barrel at a muzzle velocity sufficient to strike a remote target at not less than 518 meters/second, wherein the ratio of the external diameter of the cartridge at its widest point to the diameter of the external diameter of the projectile at its widest point is greater than or equal to 1.4 to 1, and wherein one end of said chamber enters into a rifled barrel of a diameter corresponding to external diameter of the projectile.

* * * * *